US006311706B1

(12) United States Patent
Sato

(10) Patent No.: US 6,311,706 B1
(45) Date of Patent: Nov. 6, 2001

(54) UMBRELLA RUNNER

(75) Inventor: Hiromi Sato, Yokohama (JP)

(73) Assignee: Misuzu Seiko Kabushiki Kaisha, Kanagawa-ken (JP)

( * ) Notice: Subject to any disclaimer, the term of this patent is extended or adjusted under 35 U.S.C. 154(b) by 0 days.

(21) Appl. No.: 09/554,019

(22) PCT Filed: Mar. 30, 1999

(86) PCT No.: PCT/JP99/01612

§ 371 Date: May 10, 2000

§ 102(e) Date: May 10, 2000

(87) PCT Pub. No.: WO00/18271

PCT Pub. Date: Apr. 6, 2000

(30) Foreign Application Priority Data

Sep. 30, 1998 (JP) ..... 10-277671
Nov. 9, 1998 (JP) ..... 10-317577

(51) Int. Cl.[7] ..... A45B 25/06
(52) U.S. Cl. ..... 135/28; 135/41; 135/29
(58) Field of Search ..... 135/28, 29, 30, 135/38, 39, 40, 41

(56) References Cited

U.S. PATENT DOCUMENTS 2,762,383 * 9/1956 Wittman ..... 135/28
2,796,073 * 6/1957 Wittman ..... 135/28

FOREIGN PATENT DOCUMENTS 3-7714 1/1991 (JP) .
3017521 8/1995 (JP) .
3023762 12/1996 (JP) .
09-84617 3/1997 (JP) .
09-173119 7/1997 (JP) .

* cited by examiner

*Primary Examiner*—Robert Canfield
(74) *Attorney, Agent, or Firm*—Nixon Peabody LLP; Donald R. Studebaker

(57) ABSTRACT

In an umbrella runner (2) in which a plurality of stretcher holder grooves (5) that hold stretcher ends having axial holes are formed around an end rim in a radial pattern, plate springs (12*a*, 12) for pivot support of the stretchers and having free ends that are deformed by insertion of said stretcher ends in said grooves (5) and engage the axial holes in said ends after insertion, thereby pivotally supporting said ends.

16 Claims, 14 Drawing Sheets

PRIOR ART

UMBRELLA RUNNER

TECHNICAL FIELD

This invention relates to a runner that supports stretcher ends and more particularly to a new runner that does not use a finishing wire.

BACKGROUND ART

Generally, the shaft (metal rod) of an umbrella has a structure wherein a ferrule is disposed on the top end and a handle is disposed on the bottom end, an upper runner on which the ends of the multiple ribs pivot is fixed to the upper part, and a lower runner on which the ends of the stretchers attached to the middle of each of the ribs pivot is affixed to the bottom part such that it slides freely.

FIG. 22 is a perspective view of an example of a lower runner of the prior art, where a cylindrically-shaped lower runner 2 attached to a shaft 1 such that it can slide freely is coaxially integrated with a flange portion 3 on the top of a boss portion 23, this flange portion 3 has grooves 5 which hold the ends of each of stretchers 4 and are located radially around the rim on the top surface of the flange portion 3, and a groove 6 for holding the wire is formed on the outer surface of the flange portion 3 such that it intersects with the stretcher holder grooves 5.

Also, when linking the stretchers 4 to the lower runner 2, a wire (finishing wire) 7 is passed sequentially through axial holes 4*a* provided on the ends of the stretchers 4, and as the ends are inserted in the stretcher holder grooves 5, the wire 7 is laid in groove 6 and the ends of the wire 7 are twisted together, whereby the wire 7 takes on a ring shape and supports the ends of the stretchers 4 so that they can pivot. A twisted member 7*a* of the wire 7 is generally pressed into a groove 9 on the outer surface of a protrusion 8 protruding from the top surface of the flange portion 3.

Similarly, wire is passed sequentially through the axial holes on the ends of the ribs and the ends of the wire are twisted together and support the ends of the ribs such that they can pivot on the upper runner.

However, in this kind of umbrella runner, it is necessary to the pass wire 7 through the axial holes 4*a* at the ends of the stretcher and twist the wire together in order to support the ends of the stretchers such that they can pivot, and this operation is difficult and is extremely difficult to automate. Another problem occurs when the umbrella is repeatedly opened and closed, which causes the twisted member 7*a* of the wire 7 to become loose, thus allowing the stretchers to rattle or causing other problems.

Further, not only does the presence of the wire 7 which links the ends of the stretchers detract from the appearance, the end of the twisted member 7*a* which can become loose due to repeated opening and closing of the umbrella may injure a finger or catch on clothing and damage it.

To prevent that, covering of said twisted member 7*a* by heat-shrink synthetic resin tubing (Japanese Utility Model Registration No. 3017521) or covering the end of the twisted member 7*a* with melted synthetic resin (Japanese Utility Model Registration No. 3023762) have been proposed, but this kind of processing in addition to twisting the ends of the wire 7 together makes the operation of linking the umbrella stretchers even more difficult.

Also, in order to improve the umbrella stretcher linking operation, various stretcher pivoting structures that eliminate the wire passed through the axial holes in the ends of the stretchers have been proposed; for example, in Japanese Utility Model Publication No. 3(1991)-7714, a runner structure is proposed wherein bulb members are formed on the ends of the stretchers while bulb-shaped holes corresponding to said bulb members are provided in the runner, and the bulb members of the stretchers are press-fitted into these holes, thus providing pivot support of the ends of the stretchers.

However, in this kind of stretcher pivoting structure, a special stretcher in which bulb members are formed on the ends, for example, is required thus making it impossible to use conventional stretchers with the axial holes 4*a* in the ends.

In view of the above situation, the purpose of this invention is to greatly simplify the operation of linking the stretchers to the runner and also make automation possible while allowing the use of conventional stretchers by eliminating the wire passed through the axial holes in the ends of the stretchers.

DISCLOSURE OF THE INVENTION

The runner of this invention is characterized by the use of plate springs for pivot support of the stretchers and having free ends disposed in the plurality of stretcher holder grooves disposed in a radial pattern on the rim of the end of the runner and which are deformed by insertion of the stretcher ends and then engage the axial holes in the stretcher ends after insertion to support them so they can pivot.

Said plate springs can be configured from a pair of plate springs with opposing free ends or one cantilevered plate spring.

In this case, a single metal, ring-shaped, thin plate equipped with hooked-shaped plate members or an outer ring having slits at intervals nearly equal to the intervals of said stretcher holder grooves and an inner ring linked to these hook-shaped plate members or outer ring as a unit is embedded coaxially in the runner such that the free ends of each hook-shaped plate member or slit are disposed in each of the stretcher holder grooves and plate springs are formed by the hook-shaped plate members or by the free ends of the outer ring which oppose each other via the slits.

In either case, it is desirable that a void (disposed on the side of the plate spring deformed by insertion of the stretcher) that allows deformation (deformation for engaging the free ends of the plate springs in the axial holes of the stretcher) of the plate spring when the ends of the stretchers are inserted in the stretcher holder grooves and a stopper member (disposed opposite of said void) that prevents deformation (deformation that would allow the free ends of the plate springs to deform in a direction opposite the above direction when the stretcher is pulled in a direction opposite that when it is inserted) in the opposite direction of the above deformation be formed in the runner.

Further, it is desirable that said metal, ring-shaped, thin plate be embedded in the runner by insert molding. Also, when the runner is configured from a boss portion and a flange portion in which a plurality of stretcher holder grooves are formed in a radial pattern around the end, the boss portion and flange portion may be formed as a unit, or a separately formed flange portion and boss portion may be joined mechanically. Said metal, ring-shaped, thin plate is embedded inside said flange portion.

In addition, if the runner is configured from a separately formed flange portion and boss portion joined mechanically, a configuration can be used wherein said metal, ring-shaped, thin plate is sandwiched between the flange portion and boss portion and not embedded by insert molding.

Further, the stretcher pivot support member of this invention is configured from a single metal, ring-shaped, thin plate equipped with an outer ring having slits at intervals nearly equivalent to the intervals of the stretcher holder grooves of said runner and an inner ring linked to this outer ring as a unit, and it is characterized by the formation of pairs of plate springs having free ends, which support said stretcher ends, by the part of the outer ring exposed in said stretcher holder grooves such that the free ends oppose each other via each slit.

In addition, the stretcher pivot support member of this invention is configured from a single metal, ring-shaped, thin plate equipped with hook-shaped plate members protruding outward in a radial pattern from the ring-shaped member at intervals nearly equivalent to the intervals of the stretcher holder grooves in said runner, and it is characterized by single plate springs having free ends that support said stretcher ends and which are formed by the end of the hook-shaped plate members exposed in the stretcher holder grooves such that the free ends are located in close proximity to the side wall of said stretcher holder grooves.

By means of this invention, plate springs for pivot support of the stretchers, which have free ends that are deformed by insertion of the stretcher ends in the stretcher holder grooves, engage the axial holes in said ends after insertion and support these ends such that they can pivot, are disposed in the stretcher holder grooves, and therefore the stretchers can be linked to the runner by merely inserting the stretcher ends in the stretcher holder grooves in the radial direction of the runner.

Therefore, the operation of linking the stretchers can be greatly improved, and in addition to not having to twist the wire ends, the operation of sequentially passing wire through the plurality of axial holes in the ends of the stretchers and the operation of inserting the ends of the stretchers through which the wire has been passed in the radial grooves in the flange of the runner become unnecessary, thus making it possible to automate the operation of linking the stretchers to the runner.

The runner of this invention has a major advantage in practical application in that prior art stretchers with axial holes can be used as is, and, moreover, since the wire that links the ends of the stretchers is not required, there is no wire to detract from the appearance and the lack of the twisted member of the wire eliminates the problem of injury to fingers, etc., or damaged clothing caused by the end of the twisted member.

Also, configuring said plate springs from pairs of plate springs having free ends opposing each other via a slit can be easily achieved by coaxially embedding in the runner a single metal, ring-shaped, thin plate equipped with slits in the outer ring at intervals nearly equal to the intervals of the stretcher holder grooves.

Further, the configuration wherein single plate springs are disposed in the stretcher holder grooves and have free ends located in close proximity to the side walls of the respective stretcher holder grooves can also be easily achieved by coaxially embedding in the runner a single metal, ring-shaped, thin plate having hook-shaped plate members protruding outward radially from the ring shape at intervals nearly equal to the intervals of the stretcher holder grooves in the runner such that the free end of each hook-shaped plate member is disposed in each stretcher holder groove.

By forming voids in the runner to allow deformation of the plate springs when the ends of the stretchers are inserted in the stretcher holder grooves and stopper members to prevent deformation in the opposite direction of this deformation, stretchers can be reliably prevented from becoming separated from the runner while also making it easy to assemble the stretchers in the runner.

It is desirable to have a stopper to limit the depth to which the stretchers are inserted during insertion in the stretcher holder grooves, and the surface on which the ends of the stretchers stop can be the bottoms of the holder grooves. Further, since plate springs deform easily in the direction of thickness and do not deform easily in the lateral direction, a kind of stopper is required in the direction of thickness of the plate springs, i.e., in the direction of insertion of the stretcher ends and in the opposite direction, but no stopper is required in the direction perpendicular to this direction.

Further, it is desirable to embed said metal, ring-shaped, thin plate in the flange of the runner by insert molding when the flange portion and boss portion are formed as a single unit in view of the ease of manufacturing, but in the case of a configuration wherein the flange portion and boss portion are formed as separate parts and are joined into a single unit mechanically, it is easy to change the shape and color of the boss portion.

BEST MODE FOR CARRYING OUT THE INVENTION

Embodiments of the invention are explained below based on the attached drawings.

Figure 1:
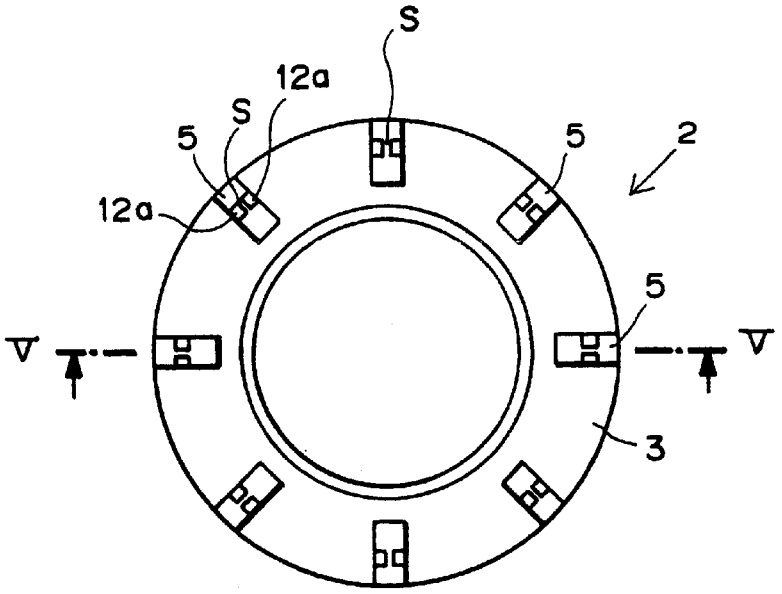
FIG. 1 is a plan view of the lower runner showing a first embodiment of the invention.
Figure 2:
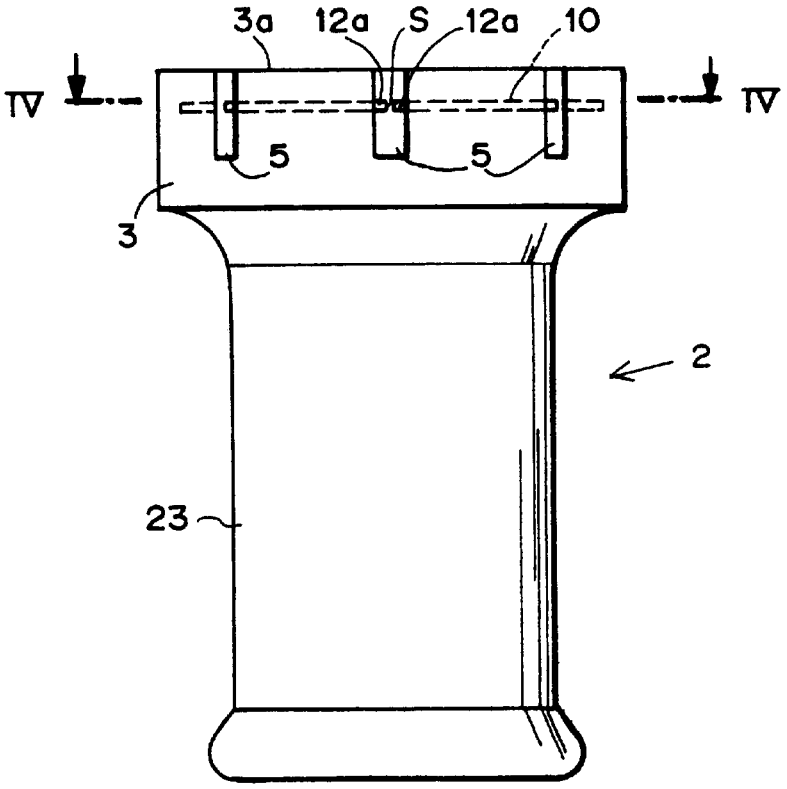
FIG. 2 is a front view of the same.
Figure 3:
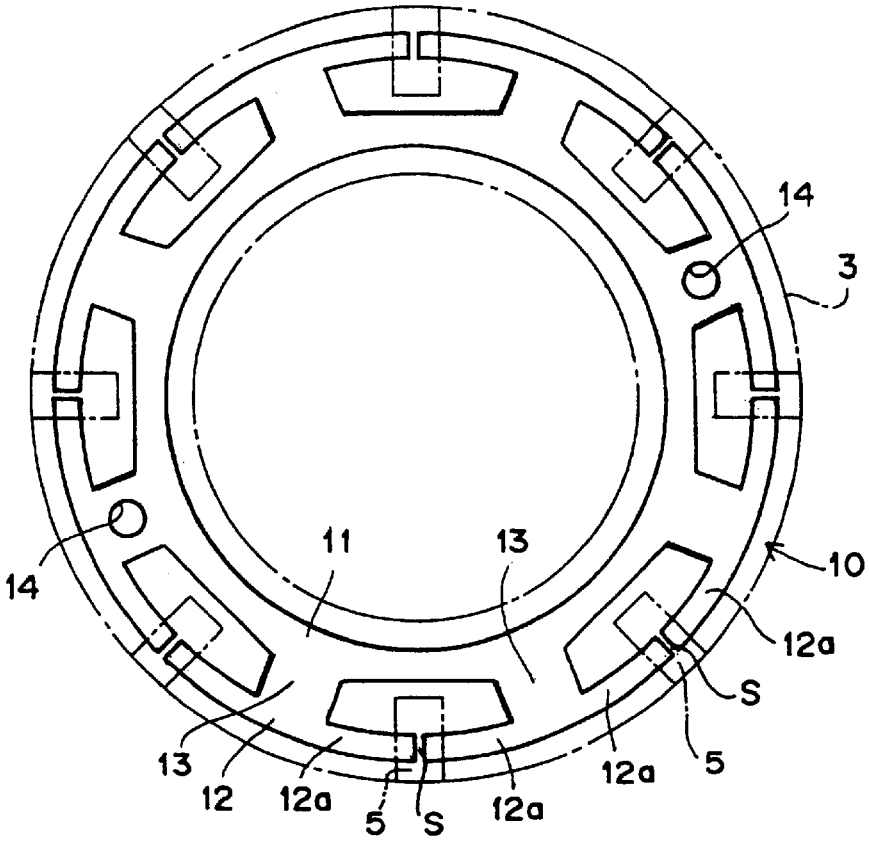
FIG. 3 is an enlarged plan view of the metal, ring-shaped, thin plate embedded in the flange portion of the lower runner.
Figure 4:
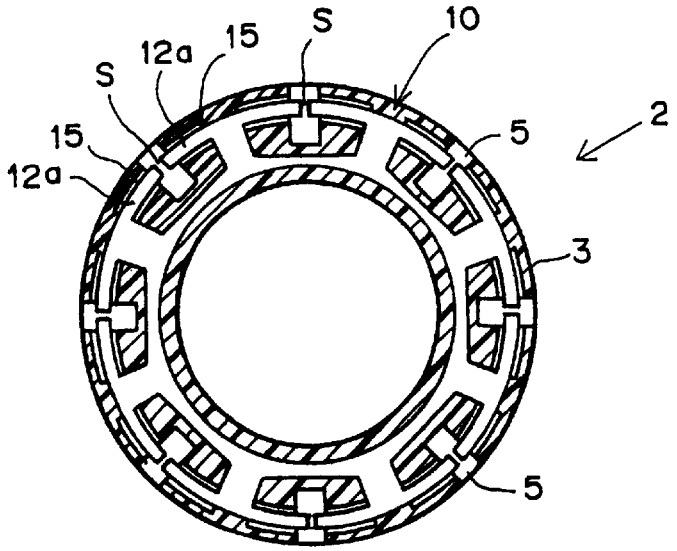
FIG. 4 is a transverse cross section along line IV—IV in FIG. 2.
Figure 5:
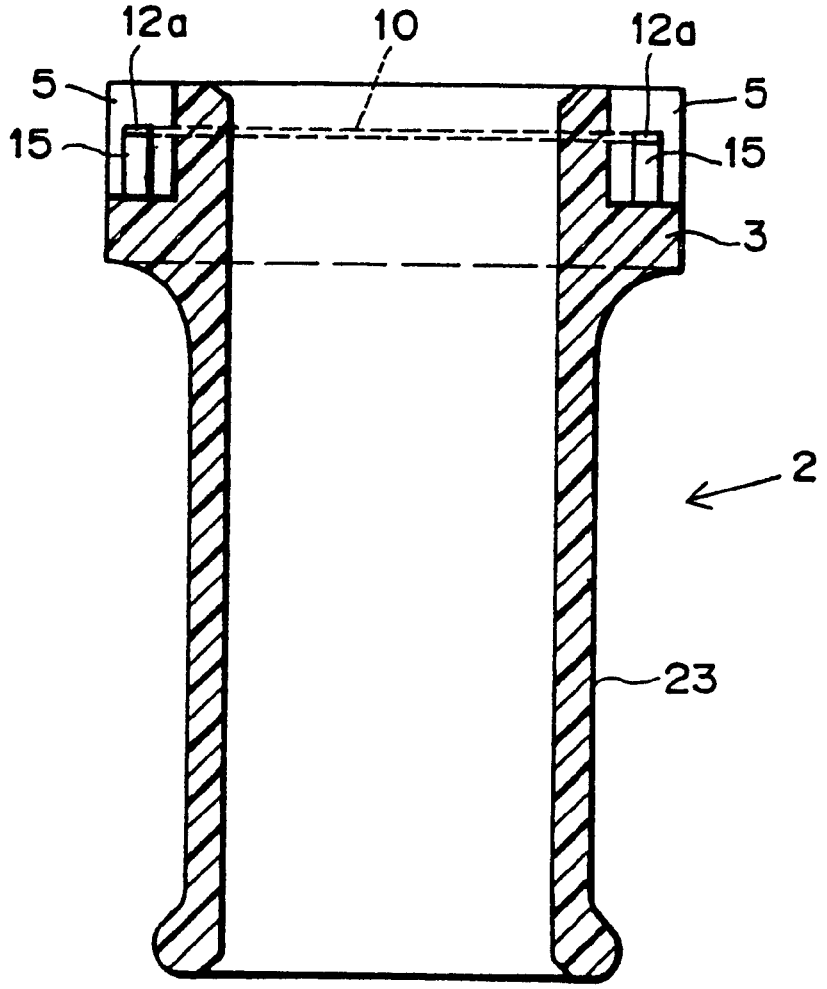
FIG. 5 is a longitudinal cross section along line V—V in FIG. 1.
Figure 6:
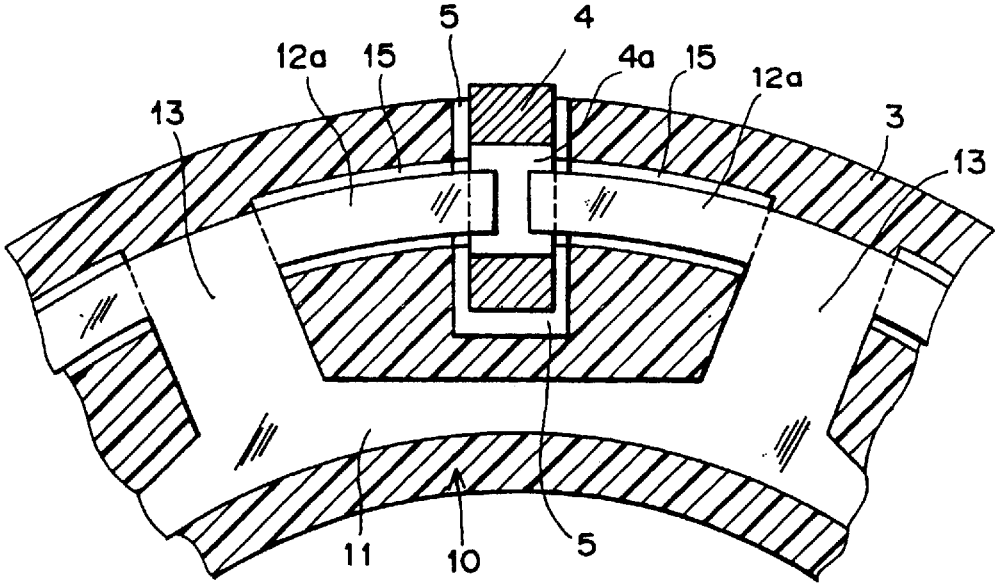
FIG. 6 is an enlarged transverse cross section of an essential portion showing a stretcher supported in a stretcher holder groove.
Figure 7:
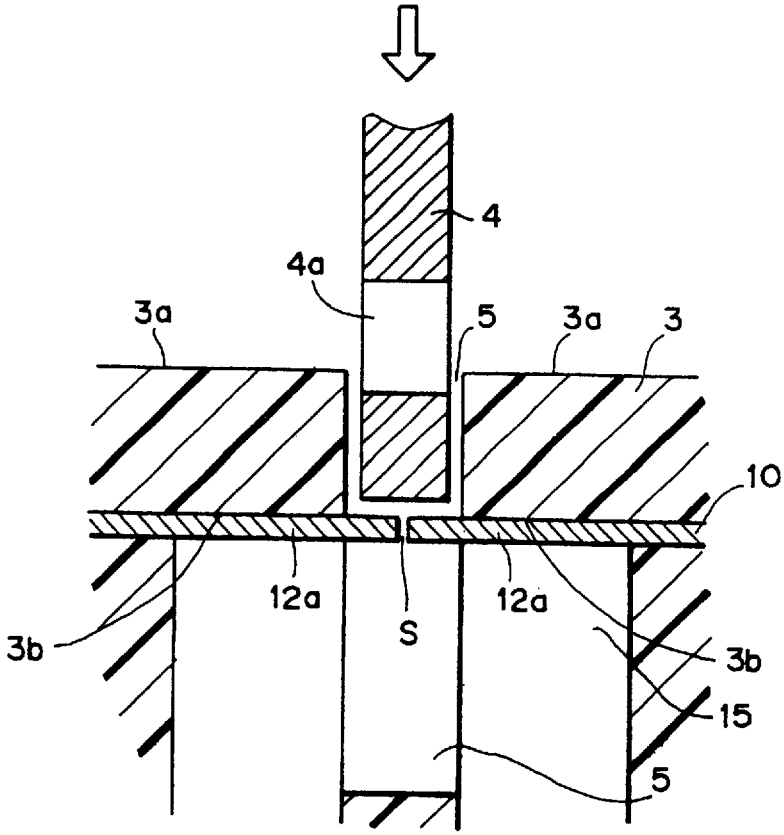
FIG. 7 is an enlarged longitudinal cross section of an essential portion showing the state before the stretcher comes in contact with the plate springs.

FIG. 1 to FIG. 7 are drawings showing a first embodiment of the runner of this invention. FIG. 1 is a plan view of the lower runner, FIG. 2 is a front view of the same, FIG. 3 is an enlarged plan view of the metal, ring-shaped, thin plate embedded in the lower runner, FIG. 4 is a cross section along line IV—IV in FIG. 2, FIG. 5 is a longitudinal cross section along line V—V in FIG. 1, FIG. 6 is an enlarged transverse cross section of an essential portion showing a stretcher being supported, and FIG. 7 is an enlarged longitudinal cross section of an essential portion showing the state before the stretcher comes in contact with the plate springs.

Figure 22:
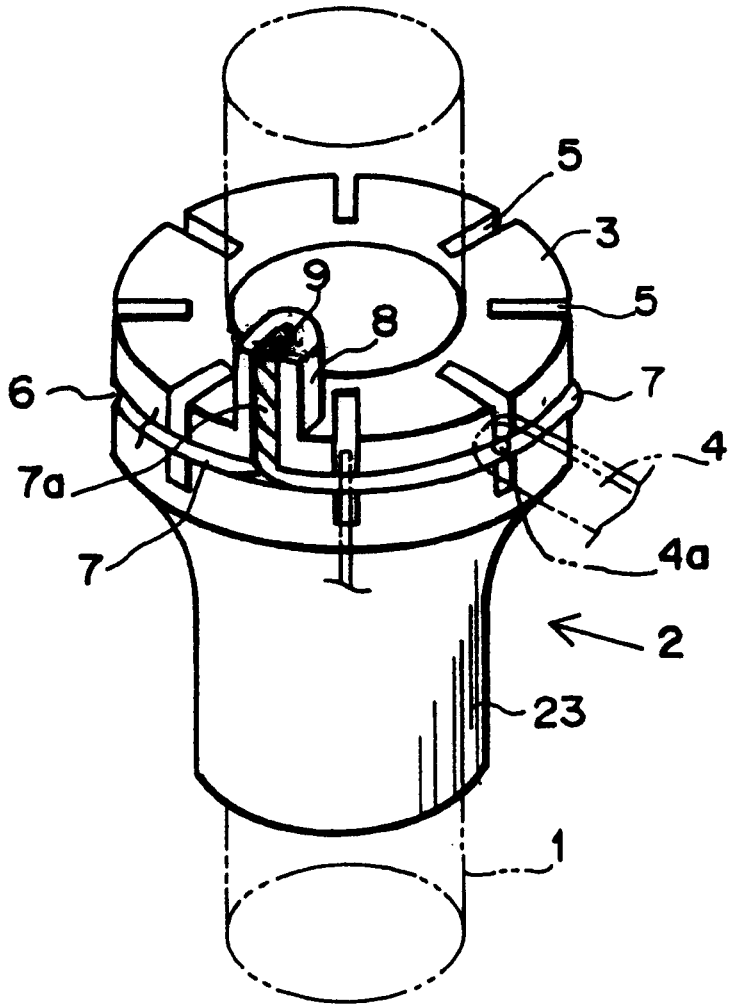
FIG. 22 is a perspective diagram showing the structure of the lower runner of the prior art.

In the figures, a lower runner 2 made from synthetic resin is configured from a cylindrically-shaped boss portion 23, which functions as the handle for opening and closing the umbrella, and a flange portion 3 formed on the boss portion 23 as a single unit, and eight stretcher holder grooves 5 that hold the ends of stretchers 4 are formed in a radial pattern in the rim on the top surface 3*a* of the flange portion 3 at nearly equal angular intervals as in the lower runner shown in FIG. 22. A metal, ring-shaped, thin plate (stretcher pivot support member) 10 with the pattern indicated by the solid line in FIG. 3 is embedded coaxially in the flange portion 3.

The ring-shaped, thin plate 10 made from 0.4-mm-thick stainless steel is equipped with an inner ring 11 and an outer ring 12 linked to inner ring 11 by radial linking member 13, and eight slits S extending in the radial direction at nearly equal angular intervals are formed in the outer ring 12 having approximate width of 0.8 mm, and said linking member 13 is located midway between adjacent slits S and S. Also, plate spring pairs 12*a*, 12*a* for supporting stretchers and having free ends opposing each other via slits S are formed by the members between the linking members 13, 13 of the outer ring 12. Also, holes 14, 14 for locating pins during insert molding are formed in symmetrical locations in the linking members 13, 13. However, these holes 14, 14 are provided when required and insert molding can be performed without the holes 14, 14.

Said slits S are formed with a width of about 0.15 mm as required by the process when the slits are formed in the metal, ring-shaped, thin plate 10 by laser processing, etc., but these do not have to be slits as long as there is a cut between the plate springs 12*a*, 12*a* such that plate spring pairs 12*a*, 12*a* will allow the stretchers 4 to pass when pressed in the stretcher holder groove 5. Of course, there must be no slits with a gap that would allow the stretchers 4 to be pulled out from between the plate springs 12*a*, 12*a* that have rebounded after insertion of the stretchers.

This ring-shaped, thin plate 10 is embedded in flange portion 3 by insert molding when the lower runner 2 is molded from synthetic resin such that the plate spring pairs 12*a*, 12*a* oppose each other with the slit S between them in each stretcher holder groove 5. Also, as is clearly shown in FIG. 7, the upper surface of the plate springs 12*a*, 12*a* other than that exposed in the stretcher holder groove 5 (approximate width of the groove 5 is 1.6 mm) is in direct contact with an inner surface 3*b* of the flange portion 3, but a void 15 (approximately 3 mm on one side) connected to the stretcher holder groove 5 is formed in the flange portion 3 on the bottom side of the plate springs 12*a*, 12*a*. By this means, the plate springs 12*a*, 12*a* can be deformed downward into the void 15, but deformation upward is prevented by the flange surface 3*b* which acts as a stopper.

Further, deformation of the plate springs 12*a*, 12*a* outward in the radial direction of the lower runner 2 does not occur easily since it is in the lateral direction of the plate springs 12*a*, 12*a*, and therefore the forces to which the stretchers are normally subjected should not cause deformation.

Figure 8:
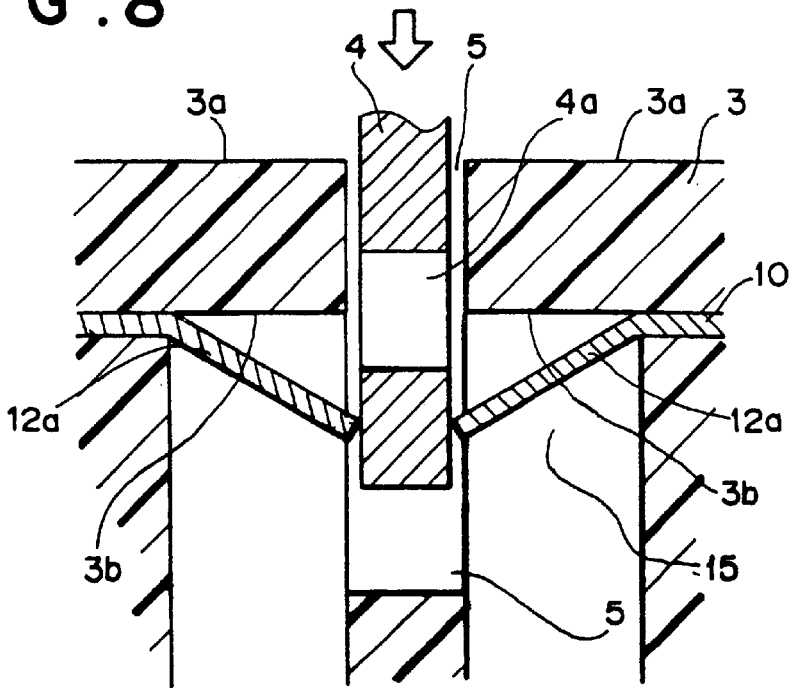
FIG. 8 is an enlarged longitudinal cross section of an essential portion showing the plate springs being flexed by a stretcher.
Figure 9:
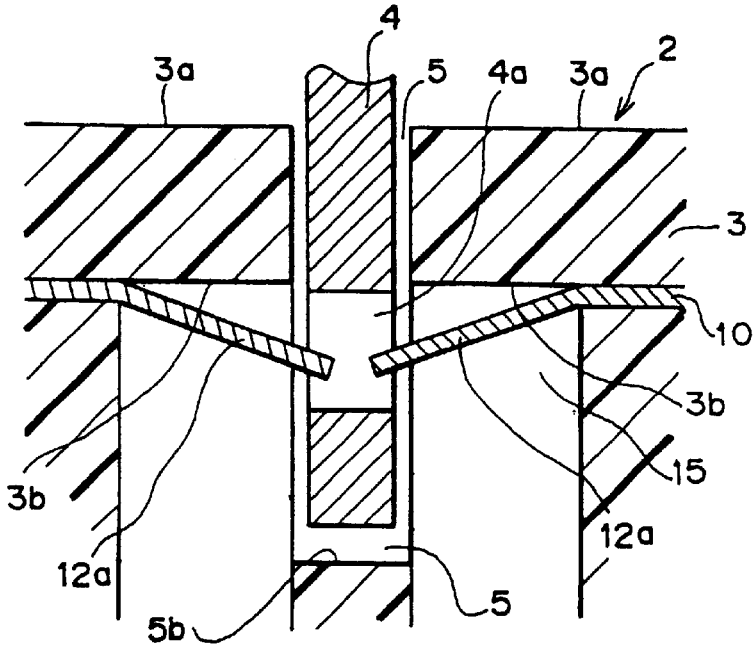
FIG. 9 is enlarged longitudinal cross section of an essential portion showing a stretcher being supported in a stretcher holder groove.

Therefore, as shown in FIG. 8, when the end (approximately 1.2 mm wide) of a stretcher 4 having an axial hole 4*a* (inside diameter approximately 1.6 mm) is inserted in the stretcher holder groove 5 downward from the upper surface 3*a* of the flange portion 3 of the lower runner 2, the plate springs 12*a*, 12*a* bend into the void 15 and allow the end of the stretcher 4 to pass, and when the axial hole 4*a* reaches the ends of the plate springs 12*a*, 12*a*, the plate springs 12*a*, 12*a* rebound due to their elasticity as shown in FIG. 6 and FIG. 9 and their free ends engage the axial hole 4*a*, whereby the end of the stretcher 4 is supported by these free ends.

Figure 10:
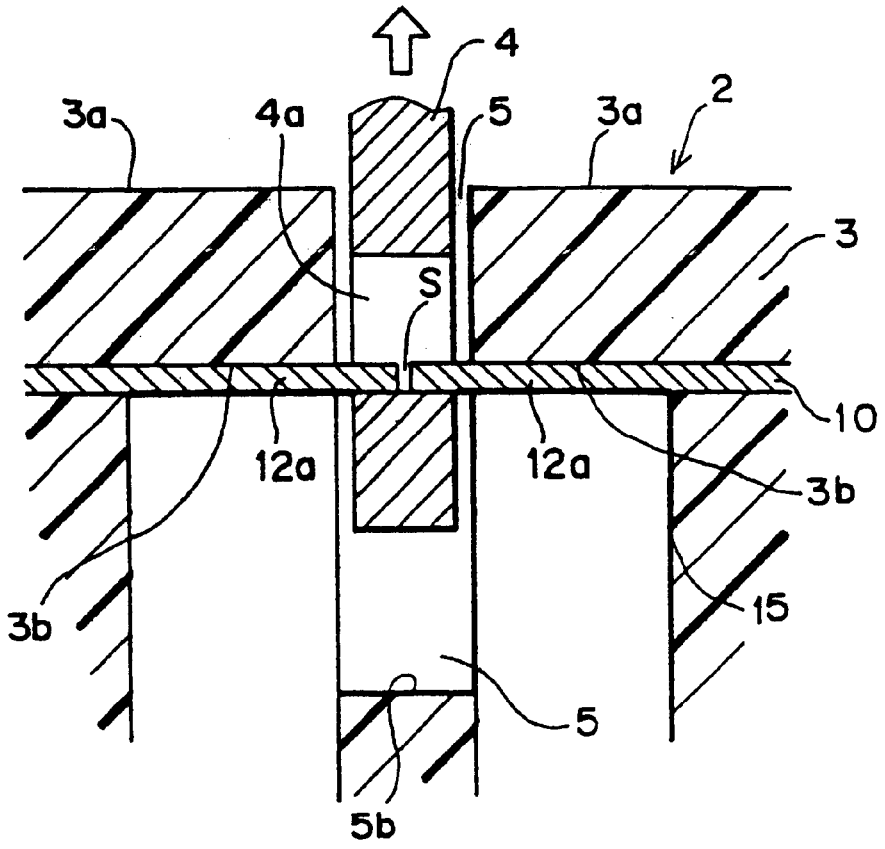
FIG. 10 is an enlarged longitudinal cross section of an essential portion showing a state in which a pulling force is being applied to the stretcher.

When a pulling force acts in the upward direction on the stretcher 4 in this condition, the plate springs 12*a*, 12*a* come in contact with the flange surface 3*b*, which constitutes the stopper member as shown in FIG. 10, at the location where they return to the horizontal state shown in FIG. 7, and therefore there is no danger of the stretcher 4 coming out of the stretcher holder groove 5.

Depending on the material of the plate springs 12*a*, 12*a*, when the end of the stretcher 4 is allowed to pass, the plate springs 12*a*, 12*a* actually undergo slight plastic deformation, and therefore when the axial holes 4*a* reach the plate springs 12*a*, 12*a*, flexure causes them to rebound only part way as shown in FIG. 9, but the plate springs 12*a*, 12*a* may be returned to their original location by pulling up the stretcher end. In this case, when the free ends of the plate springs 12*a*, 12*a* engage the axial hole 4*a* in a state in which they have not fully rebounded due to plastic deformation, the slit S between the free ends of the plate springs 12*a*, 12*a* must be sufficiently narrow depending on the extent of plastic deformation so that the free ends more deeply engage the axial hole 4*a* when the stretcher end returns.

Also, if a pushing force acts on the stretcher 4 in the depth direction (down direction in FIG. 9) of the stretcher holder groove 5, the end of the stretcher 4 comes in contact with the base surface 5*b* of the groove 5, thus preventing the stretcher 4 from moving further and causing the free ends of the plate springs 12*a*, 12*a* to come out of the axial hole 4*a*.

Figure 11:
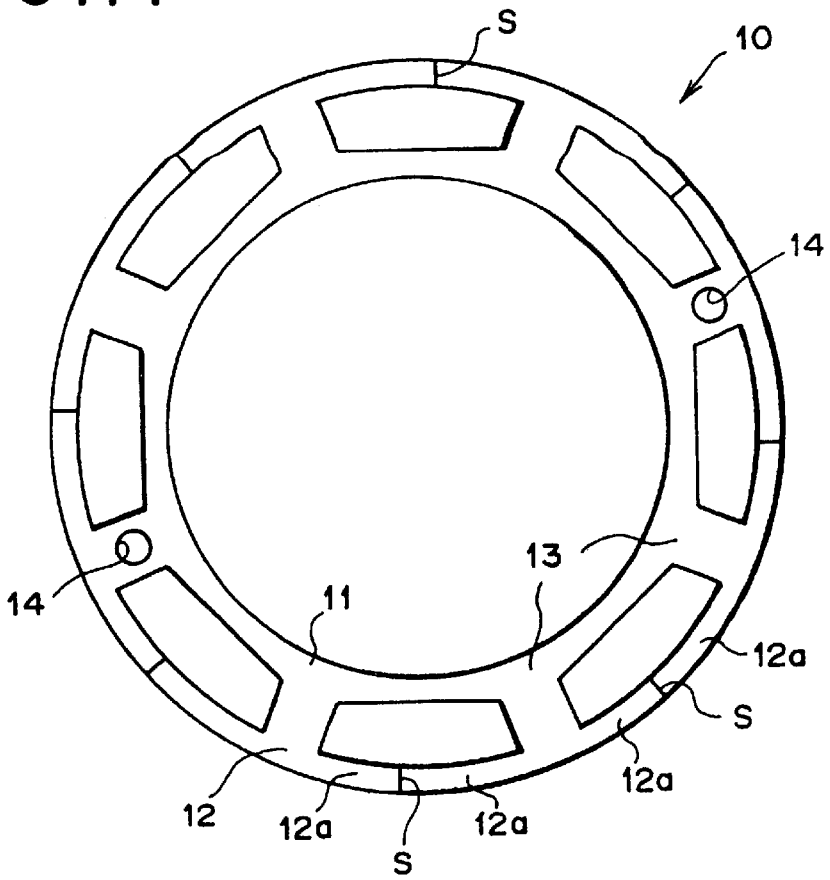
FIG. 11 is an enlarged plan view showing the shape of the metal, ring-shaped, thin plate shown in FIG. 3.
Figure 12:
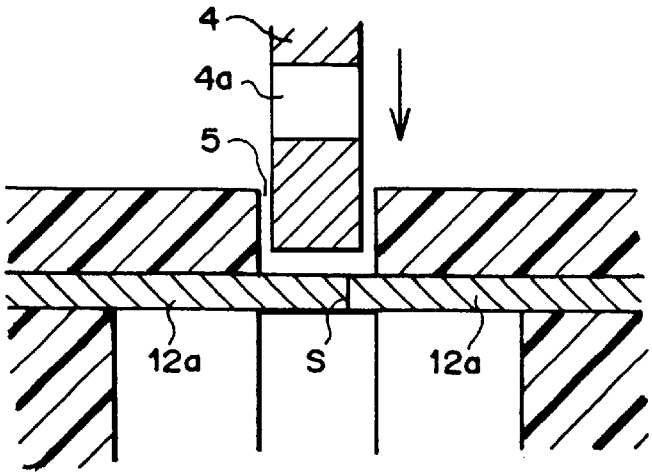
FIG. 12 is an enlarged longitudinal cross section of an area corresponding to FIG. 7 when the metal, ring-shaped, thin plate shown in FIG. 11 is used.
Figure 13:
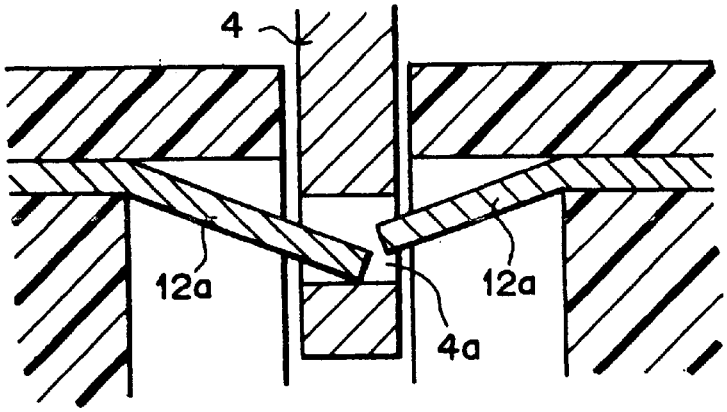
FIG. 13 is an enlarged longitudinal cross section of an essential portion corresponding to FIG. 9 when the metal, ring-shaped, thin film shown in FIG. 11 is used.

The slit S formed in the metal, ring-shaped, thin plate 10 can be located slightly to one side as shown in FIG. 11, which corresponds to FIG. 3, and in FIG. 12, which corresponds to FIG. 7, rather than in the middle of adjacent linking members 13. In this case, as shown in FIG. 13, which corresponds to FIG. 9, the plate spring 12*a* on one side will enter the axial hole 4*a* of the stretcher 4 farther, thus making it even more difficult for the stretcher 4 to come out of the groove 5.

In this way, in the configuration of this embodiment, the ends of the stretchers 4 can be reliably supported in the lower runner 2 by merely inserting the ends of the stretchers 4 in the stretcher holder grooves 5 from above the lower runner 2, and therefore the operation of linking the stretchers 4 to the lower runner 2 is made extremely simple and can even be automated.

Since the prior art stretcher 4 having the axial hole 4*a* in its end for passing the wire through it can be used as is, this is a big advantage in practical application. Moreover since the wire that links the stretcher 4 ends is not required, there is no wire to detract from appearance, and also since there is no twisted member of the wire, the problem of fingers being injured or clothing being damaged by the twisted member is eliminated.

Though it is not shown in the drawings and an explanation is omitted, the upper runner which supports the rib ends is also configured in the same way as the lower runner. Of course, it can be configured similarly with the ring-shaped, thin plate 10.

Figure 14:
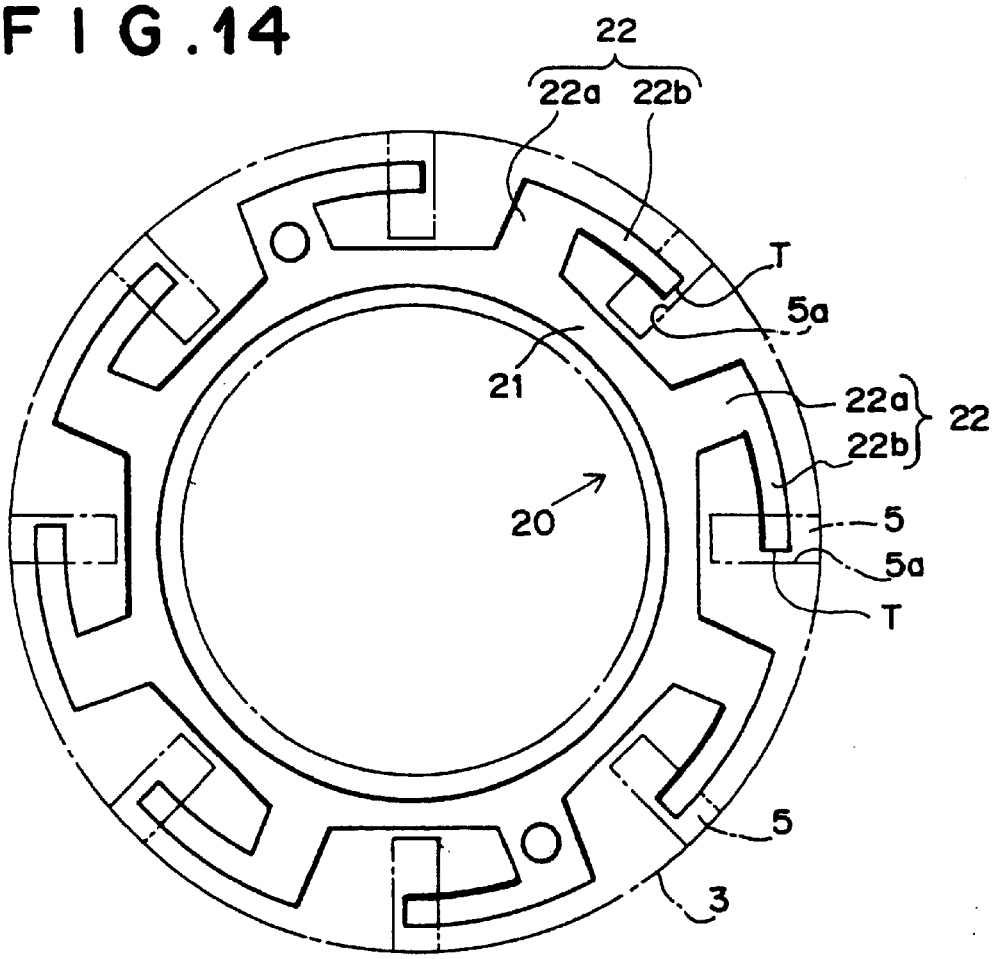
FIG. 14 is an enlarged plan view of the metal, ring-shaped, thin plate embedded in the flange of the lower runner in a second embodiment of the runner of this invention.
Figure 15:
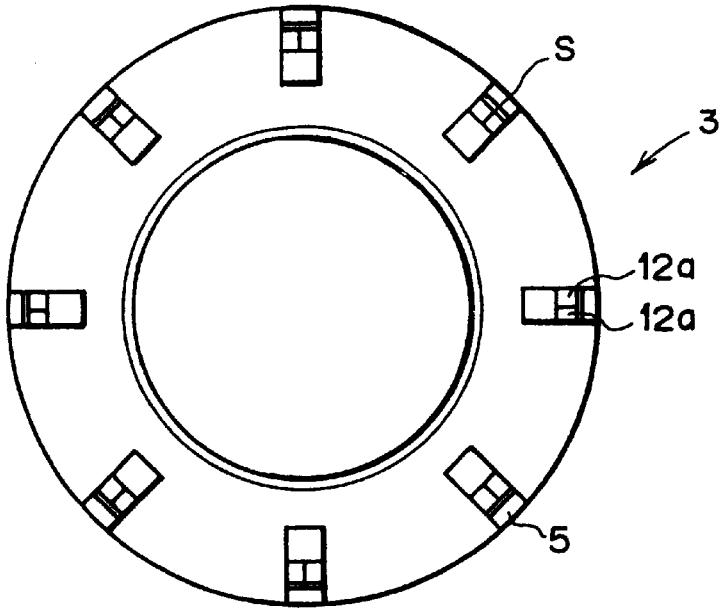
FIG. 15 is a plan view of the flange portion in a third embodiment of the runner of this invention.

FIG. 14 is an enlarged plan view corresponding to FIG. 3 showing a metal, ring-shaped, thin plate (stretcher pivot support member) embedded in the lower runner in a second embodiment of the runner of this invention. In the configuration of this embodiment, the plate spring is a one-sided spring.

A ring-shaped, thin plate 20 of this embodiment is also made from 0.4-mm-thick stainless steel like the ring-shaped, thin plate 10 shown in FIG. 3 and is equipped with a ring-shaped member 21 having the same diameter as the inner ring 11 of the ring-shaped, thin plate 10, and eight hook-shaped plate members 22 protruding outward from the outer circumference of the ring-shaped member 21 at nearly equal angular intervals. Each hook-shaped member 22 comprises a radially-shaped base member 22*a* and an approximately 0.8-mm-wide plate spring 22*b* for pivoting support of the stretchers and which extends in an arc in the circumferential direction a prescribed distance from the end of the base member 22*a*.

This ring-shaped thin plate 20 is also embedded as an insert in the flange portion 3 when the lower runner 2 made from synthetic resin is molded such that the free ends T of said plate spring 22*b* are disposed in the stretcher holder groove 5 at a location near the side wall 5*a* (0.3-mm gap) of the stretcher holder groove 5.

In this case, as well, the plate spring 22*b* is configured such that it can be deformed downward because of the void formed below the plate spring 22*b*, but its deformation upward is stopped by the flange surface which serves as a stopper.

When a lower runner 2 with a relatively smaller diameter is used, the retention force of the plate spring 22*b* on the stretcher 4 can be increased as in the case of FIG. 13 by making the plate spring 22*b* relatively longer.

By means of the configuration of this embodiment, as well, it is clear that the same effect as that of the first embodiment described above can be achieved.

In the embodiment of this invention described above, the flange portion 3 and the boss portion 23 of the lower runner 2 are formed as a single unit from synthetic resin, but the flange portion 3 and the boss portion 23 can be formed as separate parts and joined together mechanically as a single unit as in the third and forth embodiments below.

Figure 16:
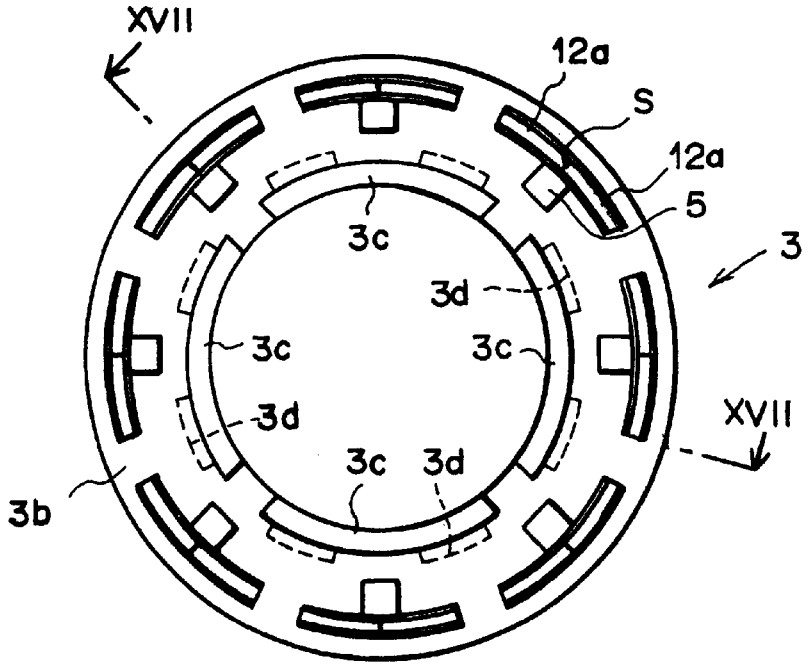
FIG. 16 is a bottom view of the same.
Figure 17:
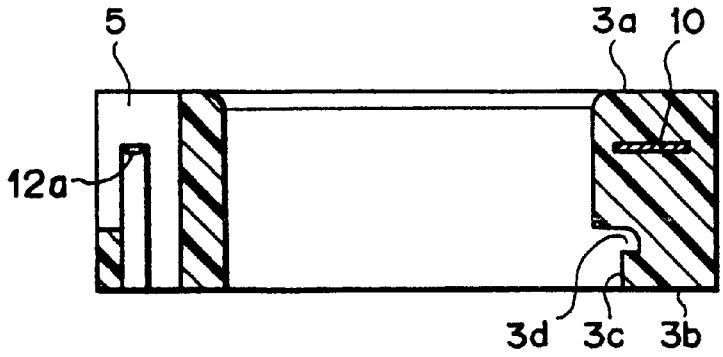
FIG. 17 is a schematic cross section along line XVII—XVII in FIG. 16.
Figure 18:
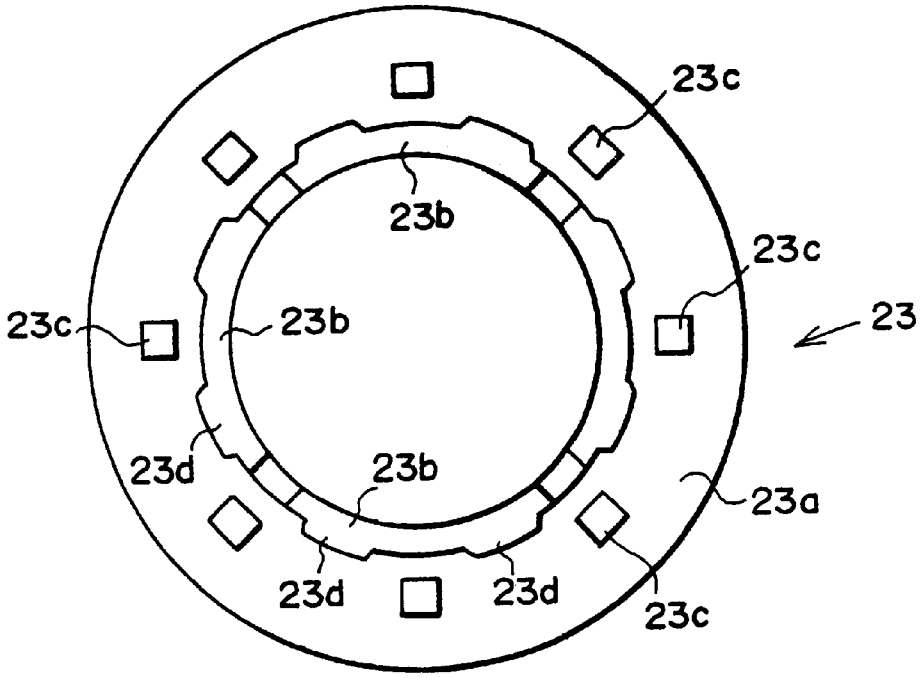
FIG. 18 is a plan view of the boss portion in a third embodiment of the runner in this invention.
Figure 19:
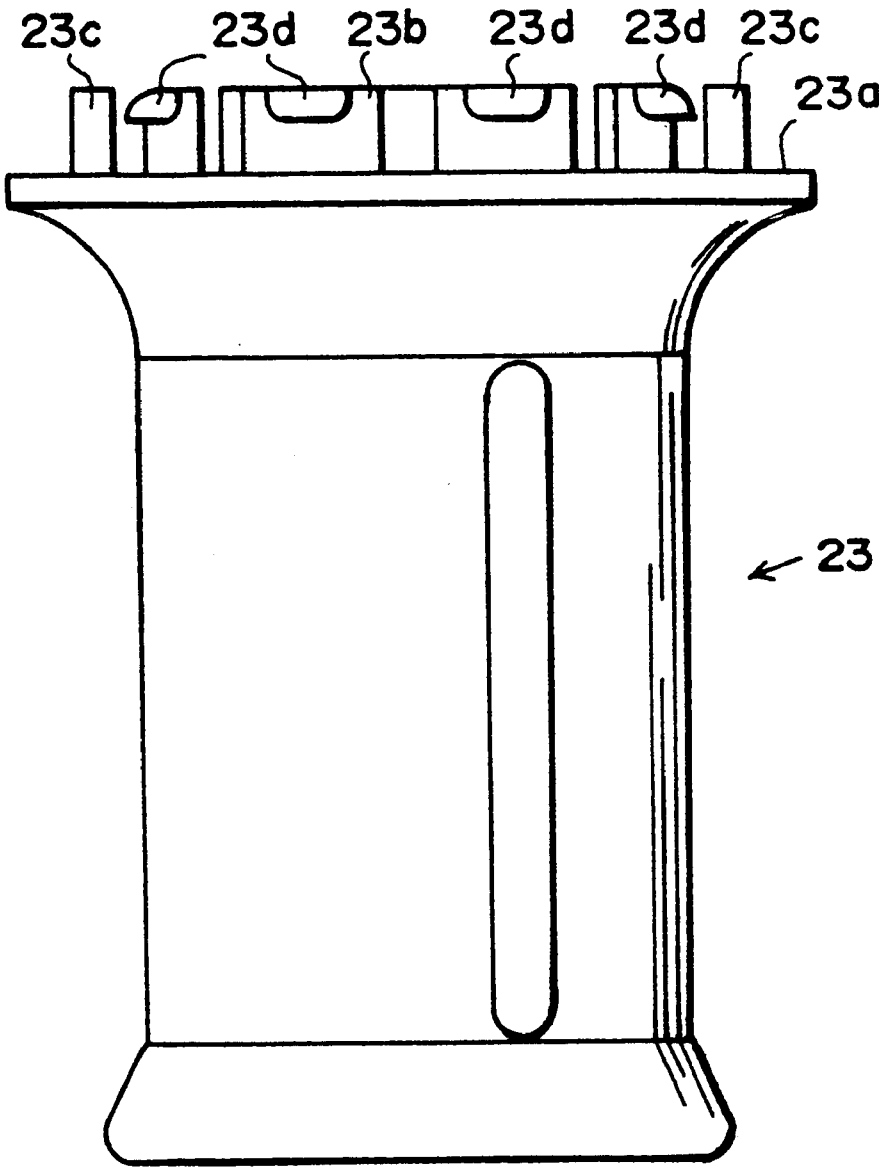
FIG. 19 is a front view of the same.
Figure 20:
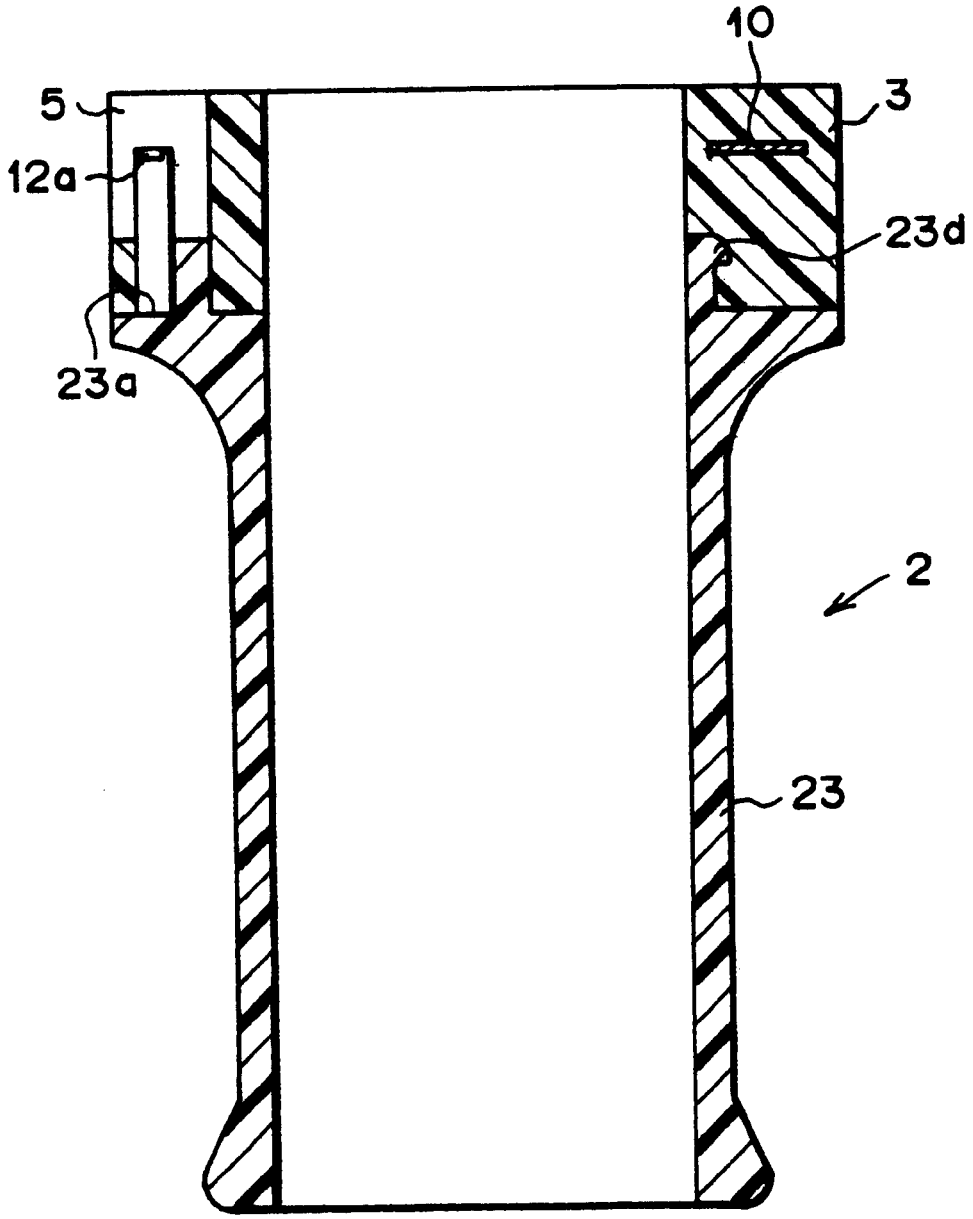
FIG. 20 is a schematic cross section of the third embodiment of the runner of this invention.

FIG. 15–FIG. 20 show a plan view of the flange portion 3 of the lower runner 2 in a third embodiment of the runner of this invention, FIG. 16 is a bottom plan view of the same, FIG. 17 is a schematic cross-sectional view along line XVII—XVII in FIG. 16, FIG. 18 is a plan view of the boss portion 23, FIG. 19 is a front view of the same, and FIG. 20 is a schematic cross-sectional view along line XVII—XVII in FIG. 16 showing the flange portion 3 and the boss portion 23 in a joined state.

Also in the flange portion 3 of this embodiment, eight stretcher holder grooves 5 for holding the end of the stretchers 4 are disposed on the rim of the top surface 3*a* at nearly equal angular intervals, and the metal, ring-shaped, thin plate 10 with a pattern like that shown in FIG. 3 is coaxially embedded in the flange portion 3 by insert molding. Further, this flange portion 3 comprises a flat cylindrical member having a flat top surface 3*a* and a bottom surface 3*b*. As shown in FIG. 16 and FIG. 17, four arc-shaped grooves 3*c* are cut beginning from a bottom surface 3*b* into the lower part of the inside wall of the center hole through which the shaft 1 passes, and two engagement indentations 3*d* are formed into the top of each groove 3*c*.

As shown in FIG. 18 and FIG. 19, a cylindrical boss portion 23, which functions as the handle for the lower runner 2 when opening and closing the umbrella, has a flat top surface 23*a*, which contacts the bottom surface 3*b* of the flange portion 3. Four arc-shaped protrusions 23*b*, which are inserted in the arc-shaped grooves 3*c* of the flange portion 3, and eight posts 23*c*, which are inserted in the stretcher holder grooves 5 of the flange portion 3, protrude from the surface 23*a*, and engagement claws 23*d*, which engage engagement indentations 3*d* on the flange portion 3, are formed on the top rim of the arc-shaped protrusion 23*b*.

Therefore, when the boss portion 23 is inserted in the flange portion 3 such that their respective shapes match up, both become joined as shown in FIG. 20, thus forming a configuration similar to the configuration of the first embodiment. The configuration of this embodiment is convenient when using a different shape or color for the boss portion 23.

Figure 21:
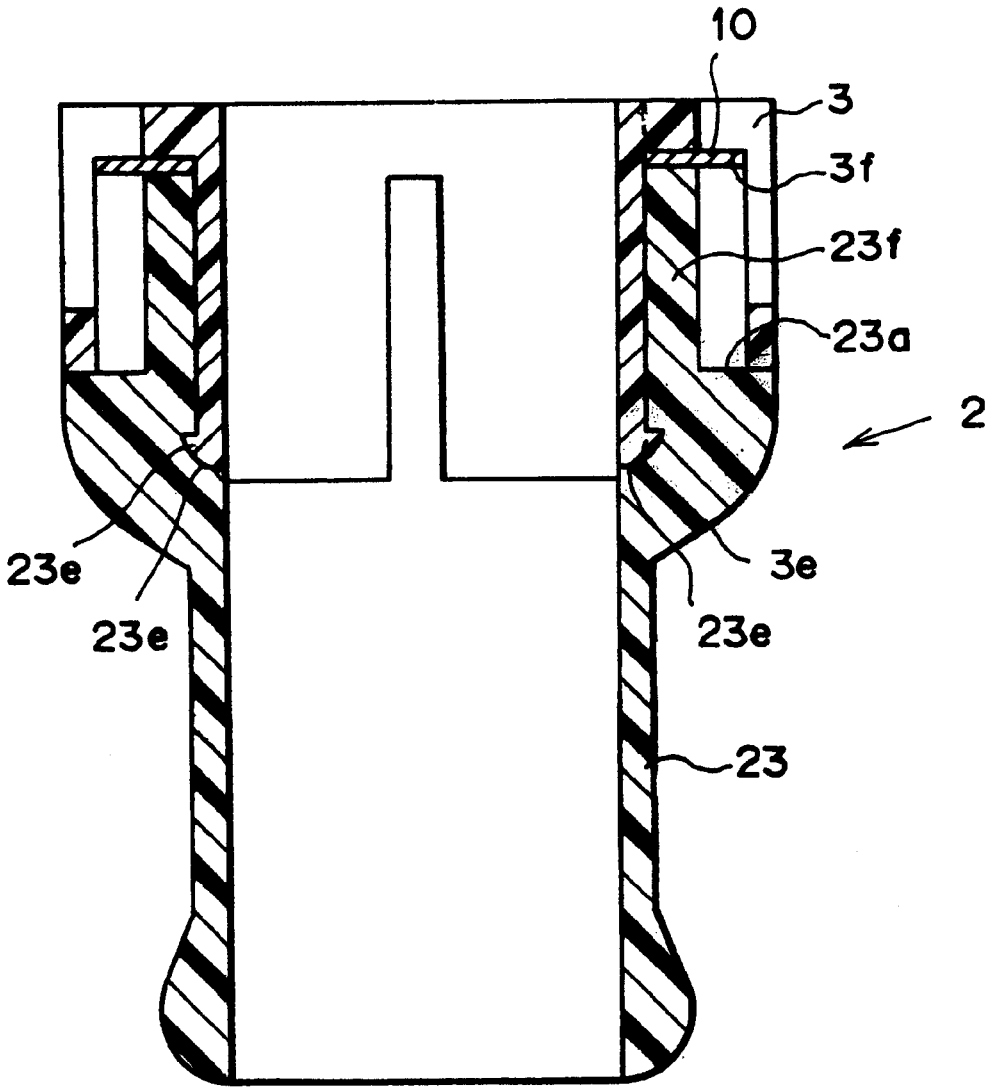
FIG. 21 is a schematic cross section of a fourth embodiment of the runner of this invention.

FIG. 21 is a schematic cross section of the lower runner 2 showing a fourth embodiment of the runner of this invention as it relates to FIG. 20.

In this embodiment, engagement claws 3*e* on the flange portion 3 and engagement indentations 23*e* on the boss portion 23 become mechanically joined by engaging each other, in which case a protruding portion 23*f* having a flat top surface on which the metal, ring-shaped, thin plate 10 rests is formed on the top surface of the boss portion 23, and the metal, ring-shaped, thin plate 10, which rests on this protruding portion 23*f*, becomes sandwiched between the bottom surface 3*f* of the flange portion 3 and the top surface of the protruding portion 23*f* of the boss portion 23 when the flange portion 3 and the boss portion 23 are joined, thus forming the lower runner 2.

As can be seen from the above description, the runner of this invention is an umbrella runner having a basic structure equipped with stretcher pivot support members disposed in stretcher holder grooves formed in a radial pattern on the end rim of the main cylindrically-shaped runner unit, wherein the stretcher pivot support members are spring members whose free ends are disposed in the stretcher holder grooves, and these spring members have elasticity whereby they can deform to allow insertion of the stretcher ends in the umbrella holder grooves for the stretchers until the axial holes reach the spring members and can rebound to enter the axial holes. Further, after the stretcher ends are inserted in the stretcher holder grooves and the free ends of the spring members enter the axial holes, the runner unit has a means to prevent the free ends of the spring members from coming out of the axial holes.

In the embodiments described above, the means for stopping the free ends of the spring members from coming out of the axial holes comprises a means for stopping deformation of the spring members that would allow the free ends of the spring members to come out of the axial holes and a means for stopping movement of the stretcher ends that would allow the free ends of the spring members to come out of the axial holes. More specifically, it comprises a stopper member (flange surface 3*b*) that stops deformation of the spring member different from the deformation allowed when inserting the stretchers in said stretcher holder grooves and a stopper member (base surface 5*b* of groove 5) that stops insertion of the stretcher end in the stretcher holder groove that would cause the axial hole to go past the spring member, but the means is not necessarily limited to a configuration that divides functions in this way.

That is, the means for preventing the free ends of the spring member from coming out of the axial hole can be either a means that prevents all deformation that would allow the free ends of the spring member to come out the axial hole or a means that prevents all movement of the stretcher end that would allow the free ends to come out of the axial hole, but both means are not necessary. The way the means are implemented is not limited to the configurations of the above embodiments.

For example, though the drawing is omitted, as a means for stopping all deformation of the spring members that would allow the free ends of the spring members to come out of the axial holes, a movable stopper can be considered that retracts to form a void next to the deformation to facilitate deformation of the springs to allow insertion when the ends of the stretchers are inserted in the stretcher holder grooves but then moves forward into the void next to the deformation after the springs have entered the axial holes to prevent subsequent deformation. Of course, fixed stoppers can be provided to constantly prevent deformation in other directions. Also, as a means to prevent all movement of the stretcher ends that would allow the free ends of the spring members to come out of the axial holes, insertion in the stretcher holder grooves that would move the axial hole past the spring members can be prevented by a stopper such as the base surface 5*b* of the groove 5 in the above embodiments, and movement of the stretcher ends in other directions can be prevented by a movable member other than the spring that enters the axial hole.

Also, since the spring member is a plate spring, it can deform in the direction of thickness but not in the lateral direction, and the above embodiments utilize this, but this invention is not necessarily limited to the use of plate springs, and it can be realized even if wire springs with a round cross section are used. In this case, a stopper can be provided that prevents deformation of the springs outward in the radial direction of the runner.

In this way, the runner of this invention can be implemented in various configurations different from the above embodiments, but in trying to make the structure as simple as possible, the above embodiments which take advantage of the utility of plate springs are preferred.

What is claimed is:

1. In a runner in which a plurality of stretcher holder grooves that hold stretcher ends having axial holes are formed around an end rim in a radial pattern, an umbrella runner characterized in that plate springs for pivot support of the stretchers and having free ends that are deformed by insertion of said stretcher ends in said stretcher holder grooves and engage the axial holes in said ends after insertion, thereby supporting said ends, are disposed in said stretcher holder grooves.

2. The runner of claim 1, wherein said plate spring comprises a pair of plate springs having free ends that oppose each other.

3. The runner of claim 2, wherein a single metal, ring-shaped, thin plate equipped with an outer ring having slits at intervals nearly equal to the intervals of said stretcher holder grooves and an inner ring linked to said outer ring as a unit is coaxially embedded such that the slits are disposed in respective stretcher holder grooves and said plate spring pairs are formed from the members of the outer ring that oppose each other via the slits.

4. The runner of claim 1, wherein said plate spring comprises a single plate spring having said free end at a location near the side wall of said stretcher holder groove.

5. The runner of claim 4, wherein a single metal, ring-shaped, thin plate equipped with hook-shaped plate members protruding outward in a radial pattern from the ring-shaped member at intervals nearly equal to the intervals of said stretcher holder grooves is coaxially embedded such that the free end of each hook-shaped plate member is disposed in a stretcher holder groove and said single plate springs are formed by the ends of the hook-shaped plate members.

6. The runner of any of claims 1 to 5, characterized by the formation of a void that allows deformation of said plate spring when said stretcher end is inserted in said stretcher holder groove and a stopper member that prevents deformation in the opposite direction of said deformation.

7. The runner of claim 3 or 5, wherein said metal, ring-shaped thin plate is embedded to form a single unit by insert molding.

8. The runner of claim 7, comprising a flange portion wherein a plurality of stretcher holder grooves are formed in a radial pattern around an end rim and a boss portion formed coaxially as a unit with said flange portion, wherein said metal, ring-shaped, thin plate is embedded in said flange portion.

9. Runner of claim 7, comprising a flange portion wherein a plurality of stretcher holder grooves are formed in a radial pattern around the end rim and a boss portion joined coaxially and mechanically with said flange portion, wherein said metal, ring-shaped, thin plate is embedded in said flange portion.

10. Runner of claim 3 or 5, comprising a flange portion wherein a plurality of stretcher holder grooves are formed in a radial pattern around an end rim and a boss portion joined coaxially and mechanically with said flange portion, wherein said metal, ring-shaped, thin plate is sandwiched between said flange portion and said boss portion.

11. In an umbrella runner having stretcher holder grooves formed in a radial pattern in an end rim of a cylindrically-shaped runner unit and stretcher pivot support members disposed in said stretcher holder grooves, an umbrella runner characterized in that said stretcher pivot support members comprise spring members whose free ends are disposed in said stretcher holder grooves, and said spring members deform to allow insertion of the stretchers in said stretcher holder grooves until the axial holes of said stretcher ends reach said spring members and have elasticity that allows them to recover so they can enter said axial holes after said deformation, and said runner unit has means to prevent the free ends of said spring members from coming out of said axial holes after said stretcher ends are inserted in said stretcher holder grooves and the free ends of said spring members engage said axial holes.

12. An umbrella runner of claim 11, wherein the means that prevents the free ends of said spring members from coming out of said axial holes comprises means that prevents deformation of said spring member that would allow the free ends of said spring member to come out of said axial holes and/or means that prevents movement of said stretcher ends that would allow the free ends of said spring member to come out of said axial holes.

13. An umbrella runner of claim 12, wherein the means that prevents the free ends of said spring member from coming out of said axial holes comprises stopper means that prevents deformation of said spring member different from the deformation that allows insertion of said stretchers in said stretcher holder grooves, and stopper means that prevents insertion of said stretcher ends in said stretcher holder grooves that would cause said axial holes to go past said spring member.

14. A stretcher pivot support member that is coaxially embedded in a runner in which a plurality of stretcher holder grooves that hold stretcher ends with axial holes are disposed in a radial pattern on an end rim, the stretcher pivot support member being characterized in that it comprises a single metal, ring-shaped, thin plate made up of an outer ring having slits at intervals nearly equal to the intervals of said stretcher holder grooves and an inner ring linked to said outer ring as a single unit, and pairs of plate springs having free ends that provide pivot support of said stretcher ends are formed from that part of the outer ring exposed in said stretcher holder grooves such that they oppose each other via a slit.

15. A stretcher pivot support member that is coaxially embedded in a runner in which a plurality of stretcher holder grooves that hold stretcher ends with axial holes are disposed in a radial pattern on the end rim, the stretcher pivot support member being characterized in that it comprises a single metal, ring-shaped, thin plate having hook-shaped plate members protruding outward in a radial pattern from the ring-shaped member at intervals nearly equal to the intervals of said stretcher holder grooves, and single plate springs having free ends that provide pivot support of said stretcher ends are formed from the end of the hook-shaped plate members exposed in said stretcher holder grooves such that the free ends are located near the side walls of said stretcher holder grooves.

16. The stretcher pivot support member of claim 14 or 15 characterized in that it is embedded in said runner as a single unit by insert molding.

* * * * *